United States Patent [19]

Hähnke et al.

[11] 3,996,192

[45] Dec. 7, 1976

[54] SPIN-DYEING OF ACRYLONITRILE HOMOPOLYMERS AND COPOLYMERS

[75] Inventors: Manfred Hähnke, Kelkheim, Taunus; Theodor Papenfuhs, Frankfurt am Main, both of Germany

[73] Assignee: Hoechst Aktiengesellschaft, Frankfurt am Main, Germany

[22] Filed: Mar. 14, 1975

[21] Appl. No.: 558,343

[30] Foreign Application Priority Data

Mar. 20, 1974 Germany ..... 2413299

[52] U.S. Cl. ..... 260/42.21

[51] Int. Cl.[2] ..... C08K 5/18

[58] Field of Search ..... 260/42.21

[56] References Cited

UNITED STATES PATENTS

| | | | |
|---|---|---|---|
| 3,122,517 | 2/1964 | Kruckenberg et al. | 260/42.21 |
| 3,755,353 | 8/1973 | Baumann et al. | 260/42.21 X |
| 3,886,152 | 5/1975 | Kuhlthau et al. | 260/42.21 X |

*Primary Examiner*—Donald E. Czaja
*Assistant Examiner*—S. M. Person
*Attorney, Agent, or Firm*—Connolly and Hutz

[57] ABSTRACT

Sparingly soluble to insoluble salts of dyestuff bases having one or more arylamino groups are useful for the spin-dyeing of acid-modified polymers containing acrylonitrile units.

14 Claims, No Drawings

SPIN-DYEING OF ACRYLONITRILE HOMOPOLYMERS AND COPOLYMERS

The dyeing of polymers or copolymers of acrylonitrile with organic or inorgainc color pigments in the spinning mass is known. But the use of such color pigments in the spinning mass has some disadvantages; when spinning it is generally not possible to avoid a clogging or a mechanic abrasion of the spinning nozzles and a consequent imprecise titer in the product. Furthermore, color pigments cannot always be prepared of consistent quality in respect of the fineness of dispersion. In addition, there may be considerable trouble with dust when these pigments are used, for example when they are added to the spinning mass.

It is furthermore known to dye polymers or copolymer of acrylonitrile in the mass by adding complex compounds composed of heteropoly acids and basic dyestuffs to the spinning solutions (see French patent specification No. 1,068,382) or by using basic dyestuffs which have been precipitated from their aqueous solutions with the aid of sulfonic acids (see German patent specification No. 1,077,372). Nevertheless, the use of such dyestuffs has the disadvantage that they provide, in general, only weak tinctorial strength because of the high proportion of anions, if these are colorless.

In the copending Patent Application Ser. No. 527,414 filed Nov. 26, 1974, an improved process for the spin dyeing of polymers or copolymers of acrylonitrile with basic dyestuffs has been suggested, wherein spinning solutions of polymers contain basic dyestuffs which may be present in the form of free dyestuff bases (carbinol- and anhydro bases). Preference is given to such bases of dyestuffs which are only sparingly soluble or insoluble in water. also as salts of strong acids.

It now was found, that also salts of such dyestuff bases which are only sparingly soluble or insoluble in water and which contain one or more, preferably 1 to 4 arylamino groups, in which the aryl radical may contain non-ionic groups, can be used for spin dyeing of acid modified polymers or copolymers or acrylonitrile. Especially suitable dyestuffs are those which form with practically all acids salts which are sparingly soluble or insoluble in water. Arylamino groups are especially secondary phenylamino and naphthylamino groups, which may optionally be substituted in the nuclei by lower alkyl, lower alkoxy or lower carbalkoxy groups, preferably by methyl, methoxy or carbomethoxy groups and / or chlorine or bromine atoms. The term "lower" means here and in the following that such alkyl moieties contain 1 to 6, preferably 1 to 4 carbon atoms.

Suitable dyestuffs to be used in form of their in water-insoluble or sparingly soluble salts are especially those which belong to the triarylmethane, indoldiarylmethane, azine, oxazine, thiazine, acridine or xanthene series. Such dyestuffs are described, for example, in German Patent Nos. 949,649, 1,161,370 and 1,161,371, in French Patent Nos. 1,533,149, 1,560,192, 2,030,081, 2,024,450, 2,099,211 and 2,121,198, in Belgian Patent Nos. 755,141, 761,851 and 782,681 and in Swiss Patent Nos. 519,552, 521,418 and 522,022.

Especially suitable are the salts of triphenylmethane-, indoldiarylmethane, azine-, xanthene-, and oxazine dye-stuffs of the general formulae I to V.

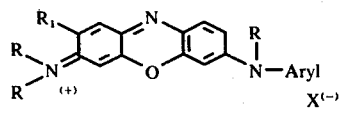
(I)

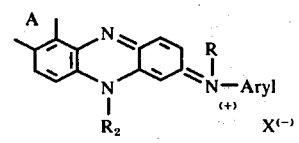
(II)

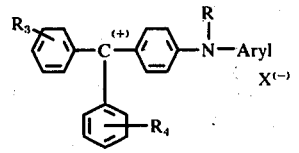
(III)

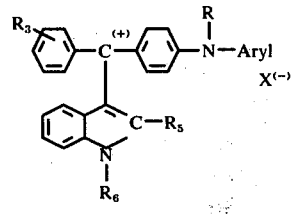
(IV)

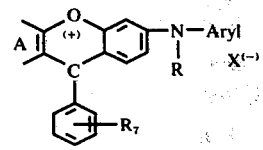
(V)

wherein

R represents hydrogen, alkyl groups with 1 to 6 carbon atoms or aralkyl groups, such as benzyl- or phenethyl groups, $R_1$ represents hydrogen or alkyl or alkoxy groups with 1 to 3 carbon atoms, each, $R_2$ alkyl groups with 1 to 6 carbon atoms or aryl radicals, such as optionally substituted phenyl or naphthyl radicals, $R_3$ and $R_4$ represent non-ionic substituents or amino groups standing in p-position to the central carbon atom which may optionally be substituted by aliphatic or aromatic radicals, $R_5$and $R_6$ represent hydrogen, alkyl groups with 1 to 4 carbon atoms or a phenyl group, $R_7$ represents a non-ionic substituent, especially an orthocarbalkoxy group, A represents an aromatic or heterocyclic ring-system which may contain the above mentioned substituents and $X^{(-)}$ an anion of an inorganic or organic acid; furthermore dyestuffs of the general formulae (VI) and (VII)

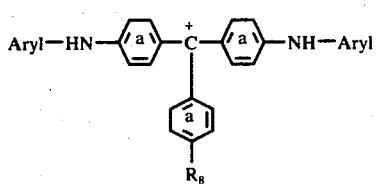
(VI)

-continued

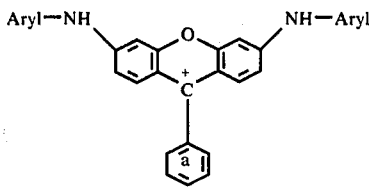

$X^-$ (VII)

wherein $R_8$ represents a hydrogen or halogen atom, for example, a chlorine or bromine atom or a -NH-aryl-group, "Aryl" represents a phenyl radical which may be substituted by halogen atoms such as chlorine or bromine atoms, alkyl groups with 1 to 3 carbon atoms such as, methyl, ehtyl or propyl groups, or alkoxy groups with 1 to 4 carbon atoms such as, methoxy, ethoxy, propoxy or butoxy, or a naphthyl radical, $X^{(-)}$ having the same signification as indicated above; the benzene nuclei marked with an "*a*" may be substituted by halogen atoms, especially by chlorine or bromine or by lower alkyl groups, especially by methyl or ethyl groups.

The anionic radical $X^{(-)}$ can be, for example, bromide, iodide, perchlorate, fluoride, chloride, hydrogensulfate, sulfate, disulfate, amidosulfate, nitrate, dihydrogenphosphate, hydrogenphosphate, phosphate, metaphosphate, hydrogencarbonate, carbonate, methosulfate, ethosulfate, cyanate, thiocyanate, hexacyanoferrate (II), hexacyanoferrate(III), tri- and tetrachlorozincate, tri- and tetrabromo zincate, stannate, borate, molybdate, wolframate (tungstate), chromate, dichromate of tetrafluoroborate.

Organic anions are, for example, anions of saturated or unsaturated aliphatic, cycloaliphatic, aromatic and heterocyclic carboxylic acids and sulphonic acids such as, acetic acid, propionic acid, chloroacetic acid, cyanoacetic acid, glycolic acid, succinic acid, glutaric acid, adipic acid, pimelic acid, oxalic acid, lactic acid, thioglycolic acid, tartaric acid, citric acid, glyoxylic acid, nitrilosulphonic acid, methanesulphonic acid, ethanesulphonic acid, chloromethanesulphonic acid, 2-chloroethanesulphonic acid, 2-hydroxyethanesulphonic acid, cyclohexane carboxylic acid, chlorohexene-3-carboxylic acid, phenylacetic acid, benzoic acid, 2-methylbenzoic acid, 3-methylbenzoic acid, 4-methylbenzoic acid, 4-tert.-butylbenzoic acid, benzenesulphonic acid, benzenedisulphonic acid-(1,3), 4-chlorobenzenesulphonic acid, 3-nitrobenzenesulphonic acid, 6-chloro-3-nitrobenzenesulphonic acid, toluenesulphonic acid-(4), toluenesulphonic acid-(2), toluene-ω-sulphonic acid, 2-chlorotoluenesulphonic acid-(4), napthalenemono or disulphonic acid or quinolinosulphonic acid-(5). Furthermore, the anions of arylsuphinic-, phosphoni- and phosphonous acids, such as benzene sulphinic-and benzene phosphonic acids are suitable.

In the process according to the invention, the dyestuff salts are preferably disolved in the same solvent as that used for the dissolution of the polyacrylonitrile and added to the spinning solution; suitable solvents are, for example, dimethylformamide, dimethylacetamide, or dimethylsulphoxide. The mixture is then homogenized and spun in the usual way — for example, according to the dry spinning process — but preferably it is spun according to the wet spinning process. The fibres thus prepared then are after-treated in the usual manner.

The dyestuff salts of the invention present a very high solubility in the beforementioned solvents, already at room temperature so that they can advantageously be used also in form of concentrated solutions which contain preferably about 5 to 20 % by weight of the dyestuff salt. The solubility of the dyestuff salts can be increased considerably by raising the temperature.

Besides the polymers of acrylonitrile, copolymers of acrylonitile with other vinyl compounds such as, for example, vinyl chloride, vinyl fluoride, vinylidene chloride, vinyl acetate or propionate, vinyl pyridine, vinyl imidazole, vinyl pyrrolidone, vinyl alcohol, acrylic or methacrylic acid esters or acrylamides may be used, wherein these copolymers must have at least 70% by weight of acrylonitrile and contain furthermore acid groups which are introduced as terminal groups into the polymer by means of a catalyst or are incorporated by polymerisation or grafted upon by means of comonomers containing such acid groups.

According to the process of the invention avoiding the formation or the presence of other salts, completely transparent spinning solutions which are free from specks, are obtained; they do not provoke any clogging or mechanic abrasion of the spinning nozzles. The filamente and fibres resulting from the spinning process present no matting effects due to an almost molecular dispersion of the dyestuff salts used according to the invention contrary to the color pigments actually applied. Furthermore the materials dyed with the dyestuff salts by the process according to the invention possess a very high fastness to wet processing.

Due to the lack of dyestuff aggregates on the fibre surfaces as they may appear in spin-dyeing with color pigments, the fibres of the invention present also an outstanding fastness to rubbing. Beside that, the fastness to thermofixation to steaming and to washing, especially the considerably improved fastness to light of the fibres dyed according to the process of the invention have to be underlined, as they are evidently higher as on fibres which are dyed by applying the dyestuff from an aqueous dyeing bath in a usual and suitable manner on the spun colourless polymer material. Furthermore, the fastness to light is considerably better than that obtained with the same dyestuffs applied on a polyacrylnitrile substrate such as, for example, yarn, flocks, knitted fabrics or woven goods according to the exhaust process. For the purpose of adjustments of shades, any combination of these dyestuffs is possible.

Due to their low solubility, respectively their insolubility in water, the dyestuff salts of the invention are especially suitable for the wet-spin process since a "bleeding" in the aqueous coagultion- and stretching baths is avoided to a large extent. Therefore it is not necessary to regenerate constantly these baths for elimination of dyestuff therein dissolved.

The preparation of the dyestuff salts cannot be effected by precipitation of an aqueous dyestuff solution with the aid of precipitant anions as otherwise commonly practiced. In order to obtain the salts of the invention, they may be obtained as salts directly in the course of the synthesis, or by dissolution of the free dyestuff bases in suitable organic solvents and precipitation by addition to an excess amount of the respective acid in an aqueous solution. Isolation of the dyestuff salt can be effected by stirring the solution of the dyestuff salt in an organic solvent onto water.

Furthermore it is possible to prepare the dyestuff salts by converting the free dyestuff base in an adequate solvent with the aid of a stoichiometric amount of the acid in question; the solvent is then distilled off.

The following examples illustrate the process of the invention. Parts are by weight unless otherwise stated.

EXAMPLE 1

10 parts of a dyestuff base of the formula

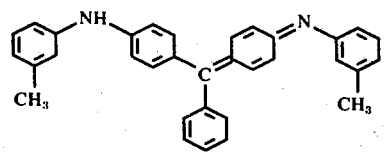

were dissolved in 20 parts of aniline at 90° – 100° C. This solution was then poured under stirring onto 100 parts of a 10% sulphuric acid of 40° C wherby the dyestuff sulfate precipitated. Stirring was continued for 1 hour; suction filtering and washing until neutral followed and the so obtained dyestuff sulfate was then dried at 60° C.

5.6 parts of a 5% solution of the dyestuff sulfate in dimethylformamide were added to 100 parts of a 28% solution of an acid-modified polyacrylonitrile in dimethylformamide. Afterwards the spinning solution was homogenized and spun according to the dry-spinning process generally known and used in the art.

Filaments having a deep green shade were obtained which excell additionally by their gloss. The fastness, especially to light, to rubbing, to thermofixation, to washing and to steaming are extremely high.

If the preparation of the fibre is effected according to the classic wet-spinning process dyed filaments are obtained which present similar good properties. The precipitating and stretching baths were only insignificantly coloured.

EXAMPLE 2

10 parts of a dyestuff base corresponding to the formula

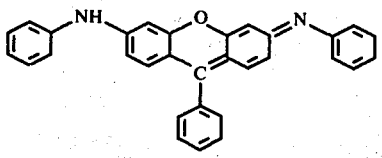

were dissolved in 100 parts of ethanol. The necessary quantity of a solution of hydrogen chloride gas in ethanol was added that a sample when poured in water, reached a pH value of about 3. The ethanol was afterwards distilled off and the residue was then pulverized.

If spin-dyeing is effected with the dyestuff chloride obtained, proceeding as indicated in example 1, a fibre material presenting a violet shade and very good properties were obtained.

EXAMPLE 3

10 parts of a dyestuff base of the formula

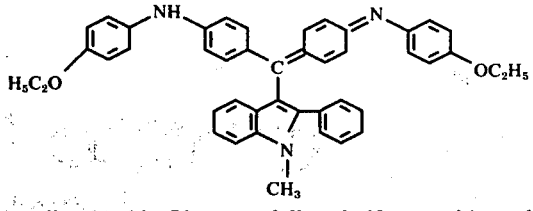

were dissolved in 50 parts of dimethylformamide at 60° C. After the addition of 2 parts of glacial acidic acid the mixture was slowly added while stirring to 100 parts of an icewater-mixture. Stirring was continued for 1 hour; after suction filtering and washing until neutral the acetate was dried at 60° C.

The spin dyeing with the dyestuff acetate obtained, effected with acid modified polyacrylonitrile according to the dry spinning process, presented a brilliant blue shade of high tinctorial strength.

The fastness to rubbing, washing, thermofixation and steaming were excellent.

EXAMPLE 4

10 parts of a dyestuff base corresponding to the formula

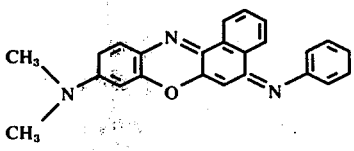

were dissolved in 50 parts of acetone and slowly precipitated by adding the solution, while stirring, to 100 parts of a 10% aqueous solution of naphthalene-1,5-disulfonic acid. Stirring was continued at room temperature for 1 hour; after suction filtering and washing until neutral the salt was dried at 60° C. The obtained dyestuff salt dyed acid modified polyacrylonitrile according to the dry spinning process in a greenish blue shade of high tinctorial strength presenting excellent fastness properties.

The table hereinafter contains further dyestuff salts of the invention indicating the shade which are obtained on acid modified polyacrylonitrile according to the wet- or dry spinning process.

| Example | Dyestuff | Shade |
|---|---|---|
| 5 | 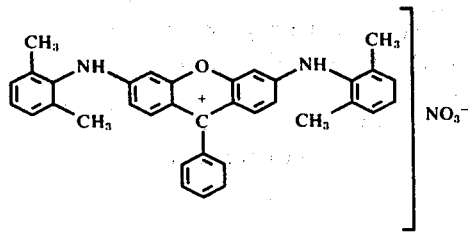 | bluish red |
| 6 | 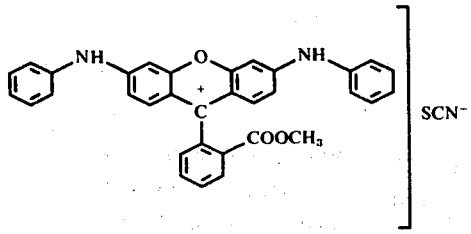 | violet |
| 7 | 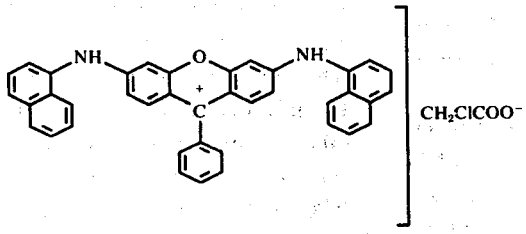 | violet |
| 8 | 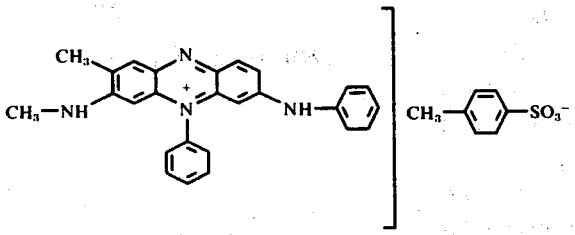 | violet |
| 9 | 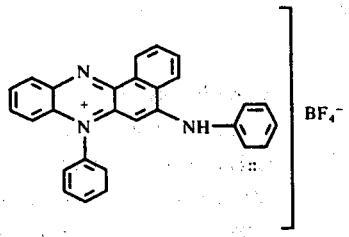 | bluish red |
| 10 | 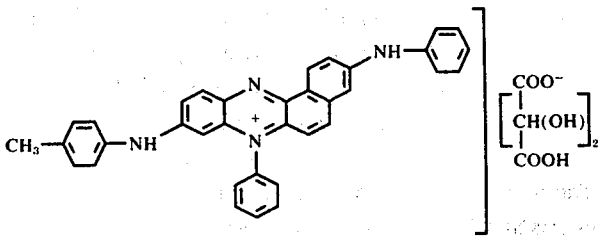 | blue |

-continued
| Example | Dyestuff | Shade |
|---|---|---|
| 11 | 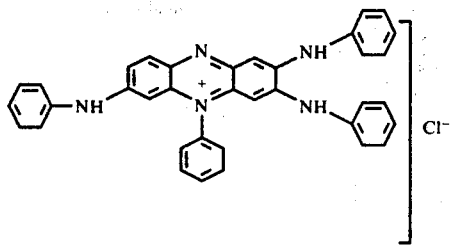 | blue |
| 12 | 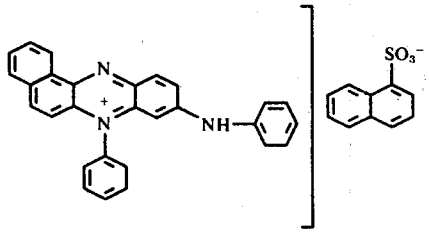 | violet |
| 13 | 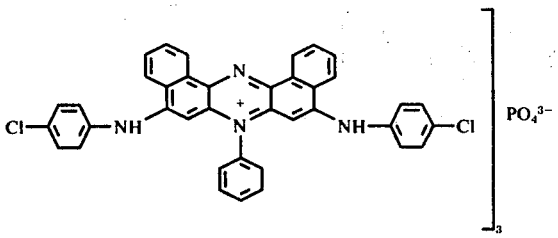 | blue |
| 14 | 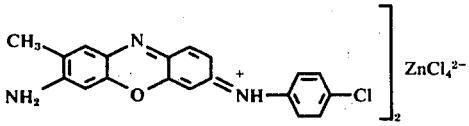 | greenish blue |
| 15 | 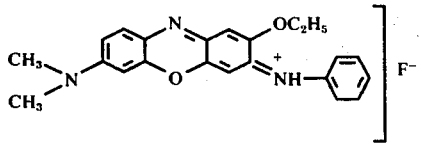 | greenish blue |
| 16 | 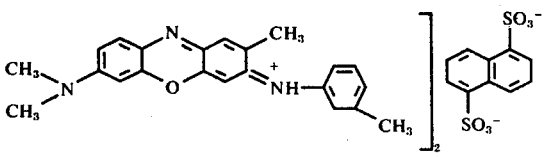 | greenish blue |
| 17 | 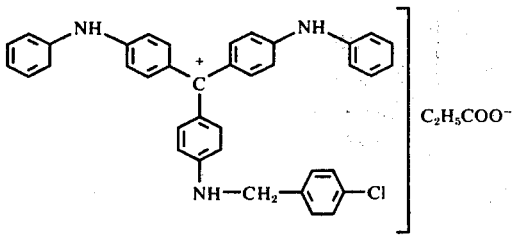 | reddish blue |

-continued
| Example | Dyestuff | Shade |
|---|---|---|
| 18 | 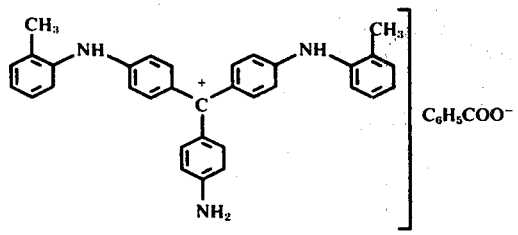 | reddish violet |
| 19 | 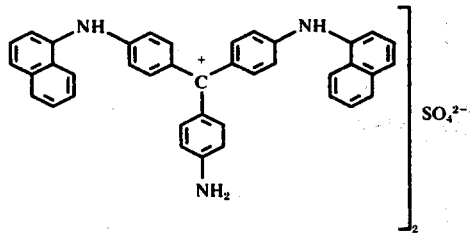 | blue |
| 20 | 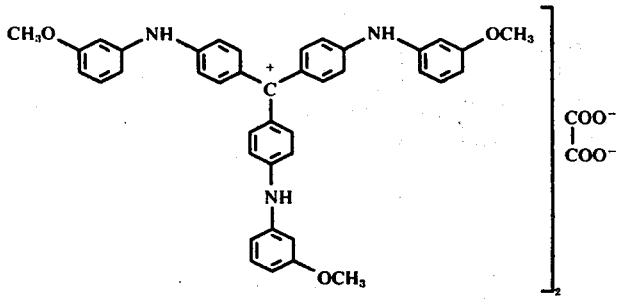 | blue |
| 21 | 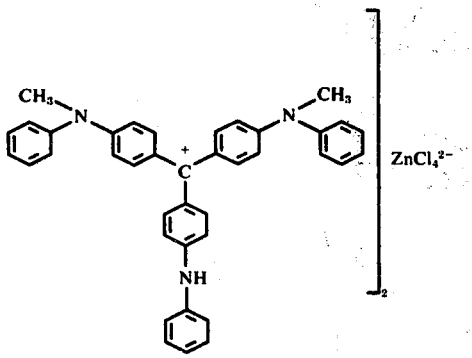 | blue |
| 22 | 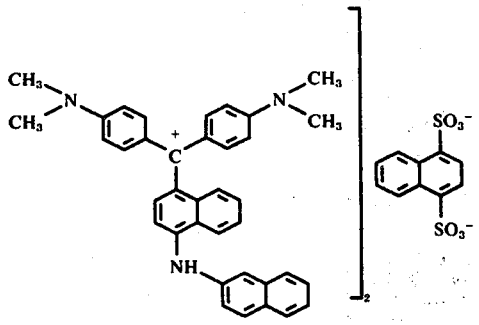 | blue |

-continued
| Example | Dyestuff | Shade |
|---|---|---|
| 23 | 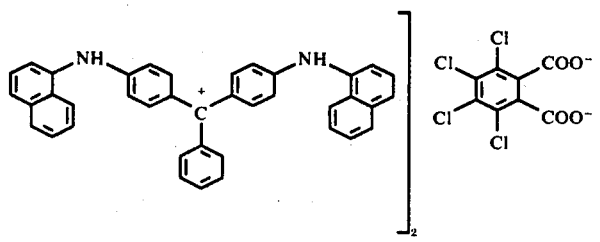 | bluish green |
| 24 | 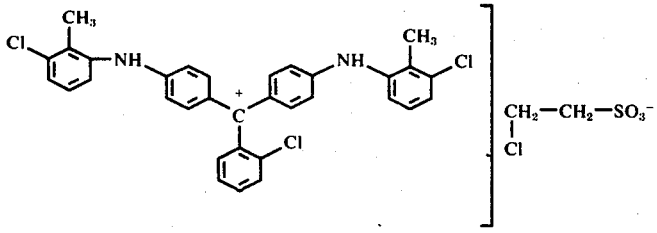 | bluish green |
| 25 | 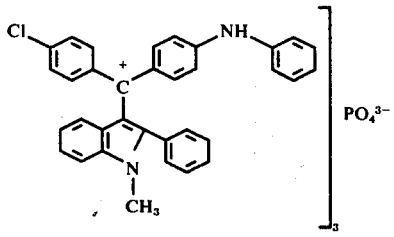 | bluish green |
| 26 | 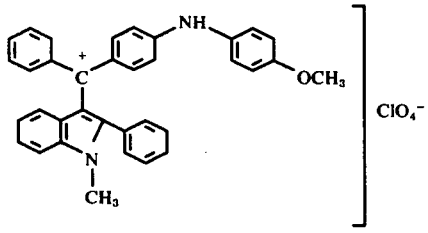 | bluish green |
| 27 | 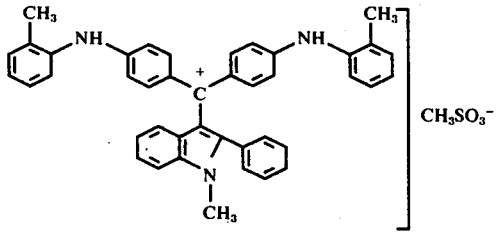 | reddish blue |
| 28 | 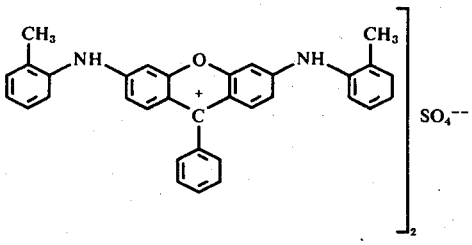 | reddish violet |

-continued
| Example | Dyestuff | Shade |
|---|---|---|
| 29 | 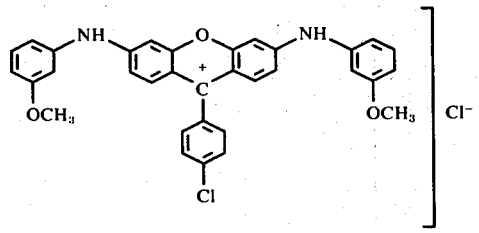 | violet |
| 30 | 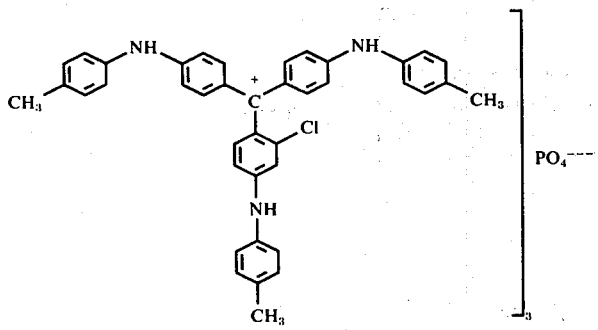 | blue |
| 31 | 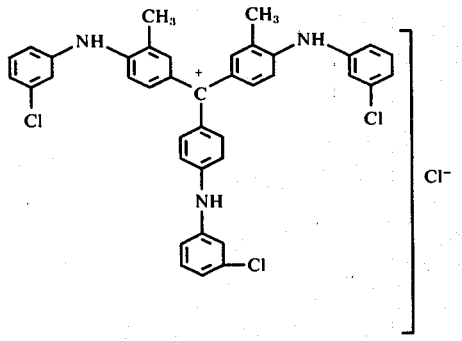 | blue |
| 32 | 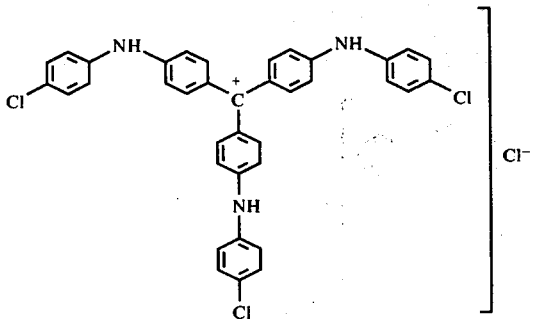 | blue |
| 33 | 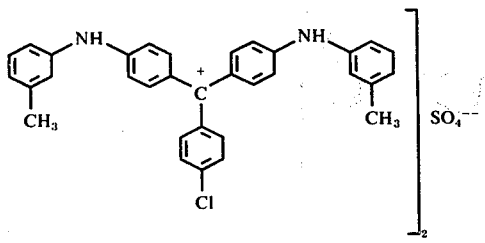 | green |

-continued

| Example | Dyestuff | Shade |
|---|---|---|
| 34 | 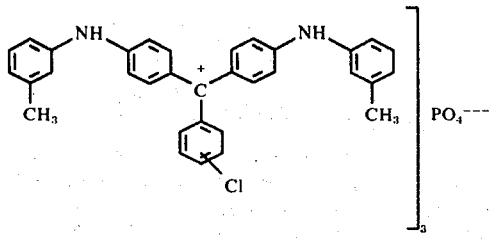 | green |
| 35 | 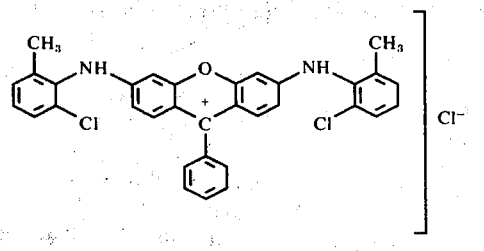 | bluish red |
| 36 | 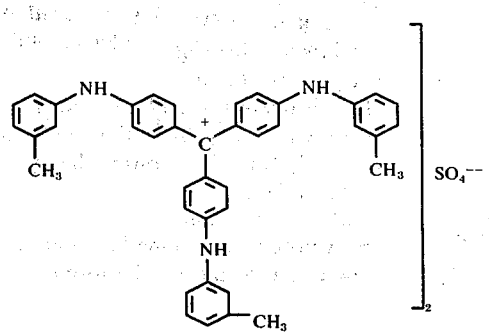 | blue |
| 37 | 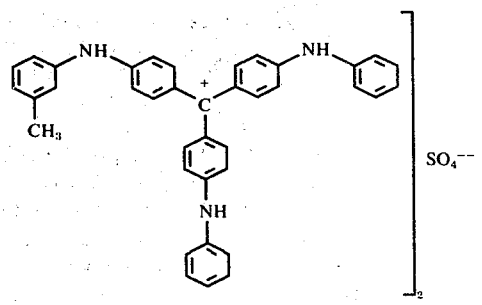 | blue |
| 38 | 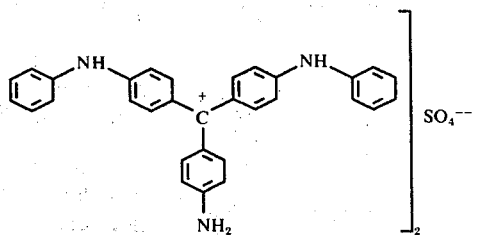 | reddish blue |

We claim:

1. In a process for the spin-dyeing of acid-modified polymers containing acrylonitrile units with basic dyestuffs the improvement comprising adding to the spinning solution a salt of a dyestuff containing at least one arylamino group which salt is sparingly soluble or insoluble in water.

2. A process as claimed in claim 1, wherein the dyestuff has 1 to 4 arylamino groups.

3. A process as claimed in claim 1, wherein the salt is of a triarylmethane, indolyldiarylmethane, xanthene, azine or oxazine dyestuff.

4. A process as claimed in claim 3, wherein the triarylmethane dyestuff salt has the formula

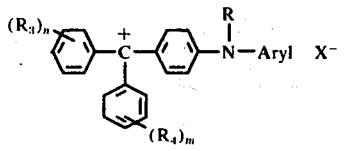

wherein R is hydrogen, alkyl of 1 to 6 carbon atoms, benzyl or phenethyl, $R_3$ and $R_4$ are lower alkyl, lower alkoxy or halogen, or p-amino which is unsubstituted or substituted by 1 or 2 substituents selected from lower alkyl,benzyl, phenethyl, phenyl and naphthyl which radicals having aromatic rings are unsubstituted or substituted in the aromatic nuclei by lower alkyl, lower alkoxy or halogen, Aryl is phenyl or naphthyl which are unsubstituted or substituted by lower alkyl, lower alkoxy or halogen, n and m are 1 or 2 and X is an anion.

5. A process as claimed in claim 3, wherein the triarylmethane dyestuff salt has the formula

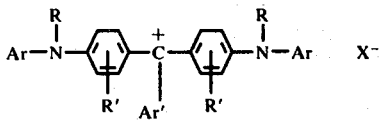

in which R and R′ are hydrogen or lower alkyl,

Ar stands for equal or different aromatic radicals selected from naphthyl, phenyl and phenyl substituted by 1 or 2 equal or different substituents selected from lower alkyl, lower alkoxy, chlorine and di-(lower alkyl)-amino, Ar′ is phenyl or naphthyl which are unsubstituted or substituted by 1 or 2 equal or different substituents selected from chlorine, lower alkyl, lower alkoxy, amino, phenylamino, naphthylamino, (lower alkoxyphenyl)-amino, chlorophenylamino, benzylamino and benzylamino substituted in the phenyl ring by chlorine, lower alkyl or lower alkoxy, and X is an anion.

6. A process as claimed in claim 3, wherein the indolyldiarylmethane dyestuff salt has the formula

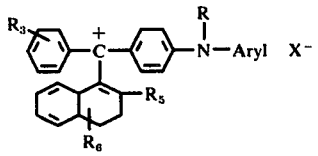

in which R is hydrogen, alkyl of 1 to 6 carbon atoms, benzyl or phenethyl, $R_3$ is lower alkyl, lower alkoxy or halogen or p-amino which is unsubstituted or substituted by 1 or 2 substituents selected from lower alkyl, benzyl, penethyl, phenyl and naphthyl which radicals having aromatic rings are unsubstituted or substituted in the aromatic nuclei by lower alkyl, lower alkoxy or halogen, Aryl is phenyl or naphthyl which are unsubstituted or substituted by lower alkyl, lower alkoxy or halogen, and $R_5$ and $R_6$ are equal or different and represent hydrogen, lower alkyl or phenyl, and X is an anion.

7. A process as claimed in claim 3, wherein the indolyldiacryl methane dyestuff salt has the formula

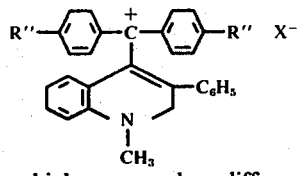

in which R″, which are equal or different, are hydrogen, chlorine, amino, phenylamino, (lower alkylphenyl)-amino, (lower alkoxyphenyl)-amino, or chlorphenylamino, and X is an anion.

8. A process as claimed in claim 3, wherein the xanthene dyestuff salt has the formula

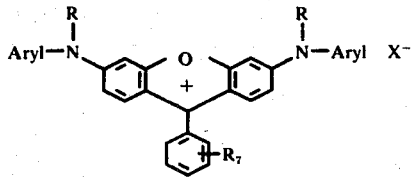

wherein R is hydrogen, alkyl of 1 to 6 carbon atoms, benzyl or phenethyl;

Aryl is phenyl or naphthyl which are unsubstituted or substituted by lower alkyl, lower alkoxy or halogen;

$R_7$ is lower alkyl, lower alkoxy, halogen or lower carbalkoxy, and X is an anion.

9. A process as claimed in claim 3, wherein the xanthene dyestuff salt has the formula

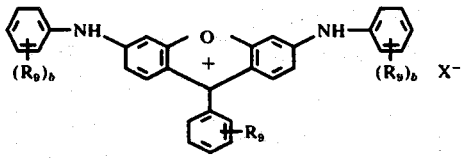

wherein $R_9$ stands for equal or different substituents selected from hydrogen, chlorine, lower alkyl, lower alkoxy, and lower carbalkoxy, or two substituents $R_9$ together stand for a fused benzene ring, b is 1 or 2 and X is an anion.

10. A process as claimed in claim 3, wherein the oxazine dyestuff salt has the formula

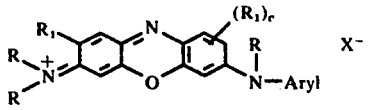

wherein R stands for equal or different substituents selected from hydrogen, alkyl of 1 to 6 carbon atoms, benzyl, or phenethyl, Aryl is phenyl or naphthyl which are unsubstituted or substituted by lower alkyl, lower alkoxy or halogen, $R_1$ stands for equal or different substituents selected from hydrogen, lower alkyl or lower alkoxy, or two substituents $R_1$ stand for a fused benzene ring, c is 1 or 2 and X is an anion.

11. A process as claimed in claim 3, wherein the oxazine dyestuff salt has the formula

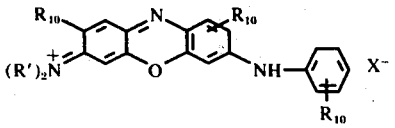

in which R′ stands for equal or different substituents selected from hydrogen and lower alkyl, $R_{10}$ stands for equal or different substituents selected from hydrogen, lower alkyl, lower alkoxy and chlorine, or two substituents $R_{10}$ stand for a fused benzene ring, d is 1 or 2 and X is an anion.

12. A process as claimed in claim 3, wherein the azine dyestuff salt has the formula

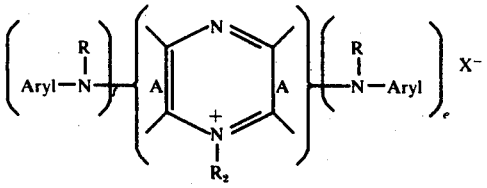

in which R stands for equal or different substituents selected from hydrogen, alkyl of 1 to 6 carbon atoms, benzyl or phenethyl, Aryl is phenyl or naphthyl which are unsubstituted or substituted by lower alkyl, lower alkoxy or halogen, $R_2$ is alkyl of 1 to 6 carbon atoms, phenyl or naphthyl, and A and A′ stand for equal or different fused benzene or naphthalene rings having to adjacent carbon atoms in common with the azine ring and which may be substituted by amino, mono- or di-(lower alkyl)-amino or lower alkyl, e and f are zero to 2 with the proviso that the sum of e and f is at least 1, and X is an anion.

13. A process as claimed in claim 3, wherein the azine dyestuff has the formula

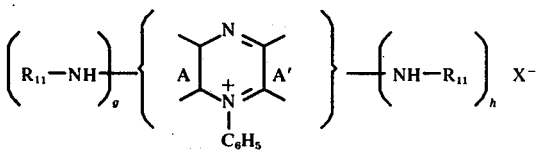

in which A and A′, which are equal or different, are fused benzene, methylbenze or naphthalene rings which have two carbon atoms in common with the azine ring, and $R_{11}$, which are equal or different, stand for lower alkyl, phenyl, chlorophenyl, lower alkylphenyl or lower alkoxyphenyl, g and h are zero to 2, with the proviso that at least one of the radicals $R_{11}$ stands for said substituted or unsubstituted, and X is an anion.

14. A process as claimed in claim 1, wherein the anion of the salt is bromide, iodide, perchlorote, fluoride, chloride, hydrogensulfate, sulfate, disulfate, nitrate, dihydrogenphosphate, hydrogenphosphate, phosphate, metaphosphate, hydrogencarbonate, carbonate, methosulfate, ethosulfate, cyanate, thiocyanate, hexacyanofferate(II), hexacyanoferrate(III), tri-and tetrachlorozincate, tri-and tetrabromo zincate, stannate, borate, molybdate, wolframate (tungstate), chromate, dichromate tetrafluoborate, or of acetic acid, propionic acid, chloroacetic acid, cyanoacetic acid, glycolic acid, succinic acid, glutaric acid, adipic acid, pimelic acid, oxalic acid, lactic acid, thioglycolic acid, tartaric acid, citric acid, glyoxylic acid, nitrilosulphonic acid, methanesulphonic acid, ethanesulphonic acid, chloromethanesulphonic acid, 2-chloroethanesulphonic acid, 2-hydroxyethanesulphonic acid, cyclohexane carboxylic acid, cyclohexene-3-carboxylic acid, phenylacetic acid, benzoic acid, 2-methylbenzoic acid, 3-methylbenzoic acid, 4-methylbenzoic acid, 4-tert.-butylbenzoic acid, benzenesulphonic acid, benzenedisulphonic acid-(1,3), 4-chlorobenzenesulphonic acid, 3-nitrobenzenesulphonic acid, 6-chloro-3-nitrobenzenesulphonic acid, toluenesulphonic acid-(4), toluenesulphonic acid-(2), toluene- -sulphonic acid, 2-chlorotoluenesulphonic acid-(4), naphthalenemono- or disulphonic acid or quinolinosulphonic acid-(5).

* * * * *